United States Patent [19]

Breglia

[11] 3,970,307

[45] July 20, 1976

[54] TARGET, PROJECTILE AND CENTRIFUGAL PROJECTOR

[76] Inventor: John E. Breglia, 818 E. Copper St., Tucson, Ariz. 85719

[22] Filed: Mar. 27, 1975

[21] Appl. No.: 562,635

Related U.S. Application Data

[63] Continuation-in-part of Ser. No. 453,513, March 21, 1974, abandoned.

[52] U.S. Cl. ..... 273/95 R; 273/97 A; 124/5; 273/146

[51] Int. Cl.[2] ..... A63B 71/02

[58] Field of Search ..... 273/95 E, 95 F, 95 R, 273/101, 105 R, 106 R, 85 R; 124/4, 5

[56] References Cited

UNITED STATES PATENTS

| | | | |
|---|---|---|---|
| 609,390 | 8/1898 | Hollstein | 273/97 A |
| 1,514,089 | 11/1924 | Kohler | 273/97 A |
| 1,873,211 | 8/1932 | Nekuda | 273/95 F |
| 2,009,252 | 7/1935 | Erickson | 124/5 |
| 2,024,034 | 12/1935 | Feitosa | 273/97 A |
| 3,052,226 | 9/1962 | Woll | 124/5 |
| 3,208,444 | 9/1965 | Sipos | 124/4 |
| 3,671,039 | 6/1972 | Niewolak | 273/95 R |
| 3,811,677 | 5/1974 | Saladrigas | 273/85 R |
| 3,841,292 | 10/1974 | Hoffman | 124/5 |

*Primary Examiner*—Richard C. Pinkham
*Assistant Examiner*—Marvin Siskind
*Attorney, Agent, or Firm*—Cahill, Sutton & Thomas

[57] ABSTRACT

A game of skill playable upon any terrain and incorporating a shaft for slinging a releasably engaged projectile toward a randomly positioned goal is disclosed. The shaft has a lateral spur extending outwardly. The projectile has a plurality of surfaces, at least two of which have a hole therein for engagement by the spur.

5 Claims, 8 Drawing Figures

TARGET, PROJECTILE AND CENTRIFUGAL PROJECTOR

The present application is a continuation-in-part of an application entitled "GAME APPARATUS", filed on Mar. 21, 1974 and assigned Ser. No. 453,513 and now abandoned, describing an invention by the present inventor.

The present invention relates to games and, more particularly to games which favor skill and athletic prowess in maneuvering an implement to direct an object toward a randomly or selectively positionable goal.

There exist many games which require the manipulation of a rod or stick to direct a thrown element toward a predetermined goal. Generally, these games require the initial establishment of certain boundary lines within a cleared terrain having a degree of flatness. The structure of the play is carefully regimented and often requires a large number of elaborate types of sticks and thrown elements. An example of one such game is disclosed in U.S. Pat. No. 3,539,186, wherein a lifting stick having a scoop-like head portion is used to lift and throw a spherical ball. The game is played within specified boundaries delineating the start position and the position of the objects to be struck by the thrown spherical ball. Thus, certain preparations must be made at a suitably flat location before play can commence.

In U.S. Pat. No. 3,731,931, there is shown a game having a pair of scoring stakes spaced apart from one another. Players stand at one of the stakes and lob a thrown element having a plurality of hooks extending therefrom toward the target stake in an attempt to engage the open end of a hook with a horizontal element extending from the target stake. By further inspection of the necessary equipment, it becomes evident that the game must be played upon terrain which is suitable for embedding the stakes therein and that specially configured multiple hook thrown elements must be used. The exercise obtained by the players is essentially limited to repetitive walking from one stake to the other.

A further game having a thrown element and a goal is disclosed in U.S. Pat. No. 3,685,826. Herein, the thrown element, formed by two weighted elements interconnected by a flexible cord, is lobbed or thrown toward a predetermined net. The object of the game is that of accurately positioning the thrown element within the net. From this description, it may be appreciated that a relatively extended space is necessary to play the game in order to incorporate any skill requirement. Further, the net remains fixedly positioned during the play of the game and the players throw the thrown element only while standing behind a predetermined throwing line. It therefore becomes apparent that the only exercise achieved by this game is that of walking between the throwing line and the net and the game is limited to a pedetermined and fixed location during play.

In conjunction with and related to the above described types of games, several implements and devices have been developed and patented. In example, U.S. Pat. No. 3,120,387, describes a hollow bat-like striking device. It includes a seat for a ball, which seat is in communication with a bellows disposed at the opposite end. In operation, the bellows is rapidly compressed to develop air pressure at the seat, which air pressure ejects the ball. After the ball has been ejected, the striking device is grasped as a baseball bat and used to strike the ball before the latter falls to the ground. U.S. Pat. No. 3,400,932, shows an enlarged die having finger holes for grasping and throwing the die. The die may be used outdoors and is thrown or rolled across a lawn or similar outdoor surface. The numerals disposed upon the die indicate the score achieved by the respective player.

U.S. Pat. No. 609,390 teaches a game emloying an apertured cube attached to a stick by a piece of string. The object of the game is that of attempting to insert one end of the stick into or through the apertured cube. This game is known in the trade as a bolero. A foot dispatched dart is illustrated in U.S. Pat. No. 1,320,267. Each player tries to manipulate the dart into a goal, such as a hoop. In U.S. Pat. No. 3,797,472, a stick is used to sling overhand a shuttlecock toward a fixed goal. The goal is a spherical member detachably mounted upon an earth implanted base. The object of the game is to dislodge the spherical member from the base by striking the former with the shuttlecock.

Other United States patents of interest include: Nos. 1,946,373, 3,052,226, 3,233,343 and 5,539,186.

In summary it may be appreciated that all of the prior art outdoor games and apparatus therefor are directed to fixedly positioned goals, are limited to relatively smooth terrain, require fixed and laid out boundaries and provide very limited physical exercise for the players.

It is therefore a primary object of the present invention to provide a game playable upon any kind of terrain.

Another object of the present invention is to provide a game which can be played while strolling along walkways or through the countryside.

Yet another object of the present invention is to provide a game which can be played outdoors or indoors.

Still another object of the present invention is to provide a game requiring only simple, inexpensive and easily producible playing pieces.

A further object of the present invention is to provide a game which can be played on the basis of skill, luck, or a combination of each.

A yet further object of the present invention is to provide a game incorporating a shaft, a releasably engaged projectile and a readily movable goal.

A still further object of the present invention is to provide a game wherein a shaft is employed to engage and launch a projectile without requiring the player to physically grasp the projectile while mounting it upon the shaft.

It is also an object of the present invention to provide an inexpensive game which can be made of any size.

These and other objects of the present invention will become apparent to those skilled in the art as the description thereof proceeds.

The present invention may be described with greater specificity and clarity with reference to the following figures, in which.

Figure 1:
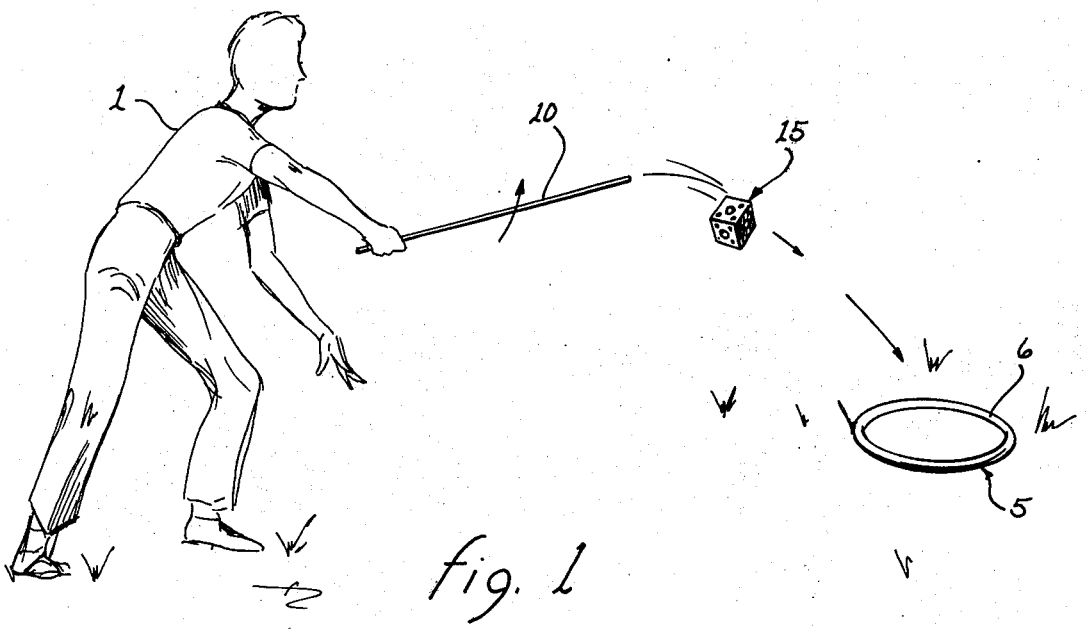
FIG. 1 is a perspective view of the game in use.

The object of the game playable with the elements of the present invention is that of using a minimum number of throws to move a thrown piece from a predetermined location to a goal. To begin play, as illustrated in FIG. 1, a player 1 inserts one end of a throwing stick or shaft 10 within a cavity disposed in a thrown piece or projectile 15 without manually touching the projectile. The projectile, whether it be a cube as shown or of some other shape, is propelled toward goal 5 by swinging shaft 10 like a golf club until the centrifugal force acting on the projectile disengages it from the shaft along a trajectory toward the goal. Alternately, the shaft may be swung in an arc like a baseball bat or overhand in the nature of a tennis serve. With practice and a minimum amount of skill, it quickly becomes possible to time and direct disengagement of projectile 15 along an accurate trajectory toward goal 5.

Goal 5 may be in the nature of a ring 6, as shown. In the alternative, it may be any existing predetermined and preselected spot upon which or within which the projectile will ultimately rest.

Should projectile 15 be short of goal 5 after the first throw, the throws are repeated until success is finally gained. Where two or more persons compete against one another, they may take turns throwing their respective projectiles or, by prearrangement, the person whose projectile is furthermost from the goal throws first.

The scoring of the game may be a factor of the number of throws necessary to place a players's projectile upon or within the goal. Alternatively, projectile 15 may be multi-faceted such that one or another of the faces is uppermost when it comes to rest and carries a certain indicia of denomination, the sum of which is attributable to the pertaining player. It thereby becomes possible to determine a player's total score by a combination of number of throws and the sum garnered from the indicia. If the latter is incorporated in the scorekeeping process, the element of skill is somewhat diminished and the element of luck becomes more predominant. Thereby, persons of varyng skill may play with equal chance of success.

From the above description of the mode of playing the game, it may become apparent to those skilled in the art that as the goal can be moved for an arbitrary distance upon completion of each game, the game is particularly attractive to persons who take walks or strolls. That is, while walking or strolling, they may play the game without regard to the terrain upon which they travel and without regard to any preconceived specified placement of the goal. In fact, a great deal of pleasure can be obtained from the game by omitting the use of ring 6 and simply using existing features of the terrain as the goal.

As the size of configuration of projectile 15 is unimportant with respect to the pleasure which may be achieved, it is possible to use a very lightweight projectile in combination with a relatively short shaft 10. Thereby the game may be played indoors without any real danger of injury to windows, furnishings, etc. It is even possible to miniaturize the projectile and shaft such that they may be used upon a table top or coffee table.

Figure 2:
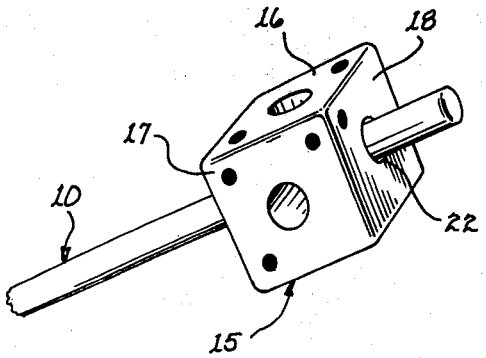
FIG. 2 illustrates a projectile releasably engaged with a shaft.
Figure 3:
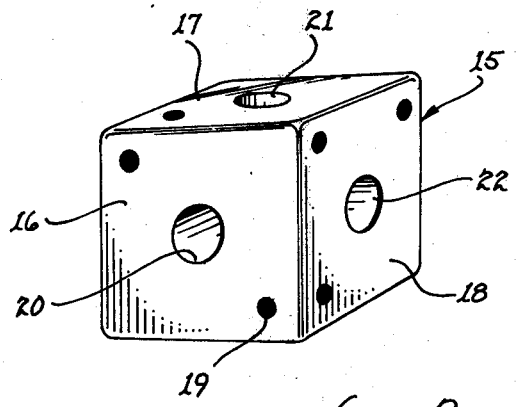
FIG. 3 illustrates a perspective view of the projectile.

Referring now to FIGS. 2 and 3 jointly, an embodiment of projectile 15 will be described in greater detail. As shown, the projectile is a cube shaped element having a plurality of faces, of which faces 16, 17 and 18 are shown. Each of these faces may include a color code or indicia 19 which assigns a predetermined numerical value to the corresponding face. Three mutually perpendicular cavities, 20, 21 and 22, extend between opposed faces of the projectile. These cavities are adapted in size and configuration to receive at least the end of shaft 10.

Shaft 10 may be a simple rod having one end of a cross-section small enough to be inserted within one of cavities 20, 21 or 22. As shown in FIG. 2, the end of the shaft can be penetratingly inserted within cavity 22.

As multi-directed cavities are employed within the projectile, it can usually be picked up by inserting an end of the shaft into the most conveniently disposed cavity and manipulating the shaft so that the projectile does not slide off but is instead lifted. By swinging the shaft through a predetermined arc in any plane, the centrifugal force acting upon the projectile will tend to cause it to slide off the shaft and travel along a trajectory. After little practice, it readily becomes possible to obtain an intuitive feel of when separation will occur such that the projectile can be lobbed or thrown toward the goal and land in close proximity to or within the goal.

Figure 4:
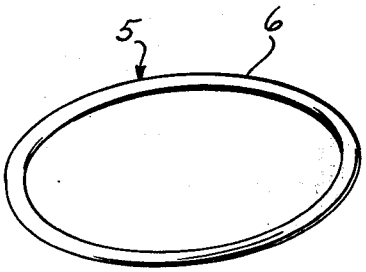
FIG. 4 is a perspective view of a movable goal.

Referring to FIG. 4, there is shown a representative goal 5 formed by a circular ring 6. As discussed above, the goal may be of any configuration and of any size depending only upon the intended degree of difficulty in placing projectile 15 therein. Moreover, it may be an existing element along the path or walkway, such as a flat rock or a smooth place. Or, the goal may simply be a tree or other protruding object with the intent being that of placing the projectile within a specified distance therefrom.

Figure 5:
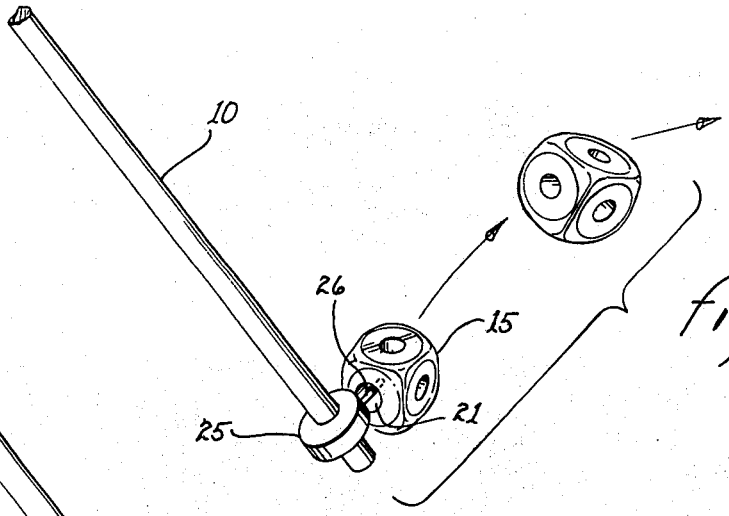
FIG. 5 illustrates a variant of the game shown in FIG. 1.

Referring now to FIG. 5, there is illustrated a variant of the above described components of the game. A collar 25, which collar may be annular as illustrated, is affixed to one end of shaft 10. The collar serves as a mounting for a spur 26 extending radially therefrom.

The purpose of spur 26 is that of engaging a cavity, such as cavity 21 of projectile 15. Depending upon the size of the projectile and the depth of the cavity disposed therein, the spur may or may not fully penetrate it. Nominally, the length of the spur is on the order of one and one-half inches.

In operation, the employment of a spur renders it somewhat easier for a player to engage and loft the projectile. Furthermore, the spur in combination with shaft 10, permits the game to be played by seated persons. That is, the game can be played easily by those sitting upon a chair, within a wheel chair, or the game may even be played by those on horseback somewhat in a manner of the game of polo. Once the projectile has been lifted above the surface upon which it rested, it is slung toward the predetermined goal as illustrated in FIG. 5 and in the manner described above.

Figure 6:
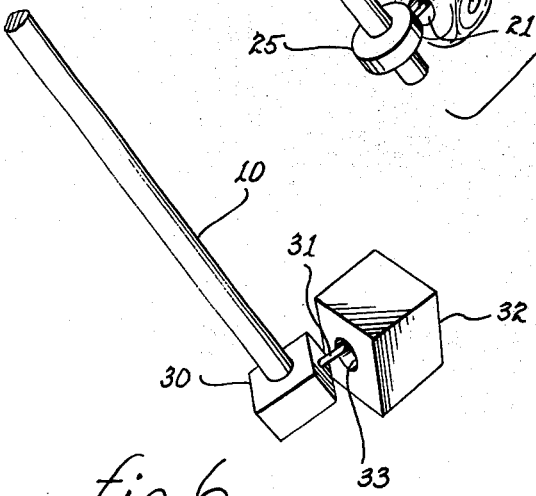
FIG. 6 illustrates a further variant of the game shown in FIG. 1.
Figure 7:
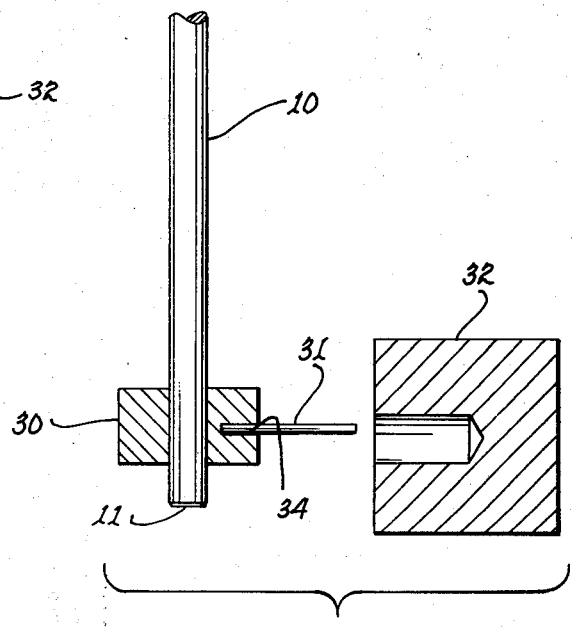
FIG. 7 is a cross-sectional view of the projectile and lower end of the shaft.

FIGS. 6 and 7 illustrate a further variant of the present invention. As shown in FIG. 6, a square shaped collar 30 is attached in proximity to one end of shaft 10. The collar may be slightly displaced from end 11, as shown in FIG. 7, or may be flush with the end without affecting the mode of play. Collar 30 supports a spur 31, which spur extends lateral to the longitudinal axis of the shaft. The spur is partially lodged and retained within an appropriately sized cavity 34 in the collar. Projectile 32 is cube shaped with a single depression or cavity 33 disposed within one side thereof. The cavity extends into the projectile to a depth sufficient to permit the cube to be engaged and lifted by spur 31 without excessive difficulty.

To those skilled in the art, and where the structural strength of the components permit, collars 25 or 30 can be deleted, provided that it is practical to insert and support the spur within the shaft itself. Moreover, as an added dimension to the game, the spur may be of flexible or rigid material. If of flexible material, additional accuracy and control can be obtained.

In operation, shaft 10 is manipulated to insert spur 31 within cavity 33. Thence, the projectile is lofted by means of the shaft and slung along a trajectory toward the predetermined goal. Thus, it may be appreciated that the projectile of the game need not necessarily include a plurality of cavities. Instead, only a single cavity is mandatory in order to effect engagement between the shaft and the projectile. Moreover, the projectile can be other than cube shaped and provided only that it include a cavity of sufficient depth to receive either shaft 10 or a spur extending therefrom.

If, during play of the game, cube 32 comes to rest upon the terrain or playing surface such that insertion of spur 31 into cavity 33 is impossible without reorienting the cube, appropriate manual reorientation of the cube must be permitted under the rules. Thus, the variant illustrated in FIGS. 6 and 7 retains all of the above discussed beneficial and pleasurable qualities of the game and yet adds the further dimension of accommodating the game to those who are seated or otherwise might have difficulty in orienting the shaft to engage the projectile. Moreover, the employment of a single cavity in the projectile reduces the costs of manufacture thereof.

Figure 8:
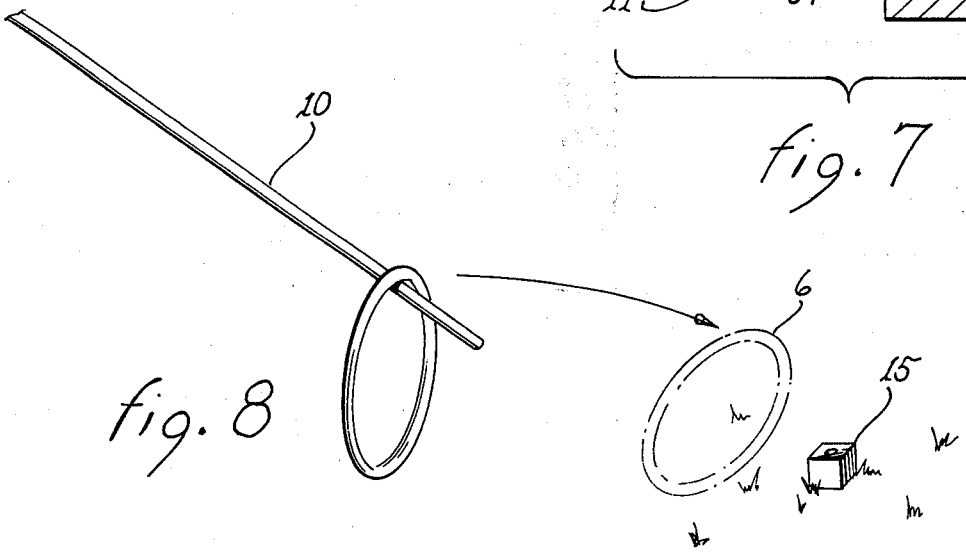
FIG. 8 illustrates a variant on the method of play shown in FIG. 1.

FIG. 8 illustrates a variant on the above described method of play. Instead of lobbing or throwing the projectile, whether it be projectile 15 or 32, the goal or ring 6 is lobbed or thrown to the projectile. That is, shaft 10, with or without spur 31, is used to engage the ring and direct it along a trajectory to the previously positioned projectile. Herein, the object of the game is that of reaching and encircling the projectile with the ring in the minimum number of throws. As an added dimension, the two sides of the ring may be designated of different numerical value such that an advantage may occur if the higher valued side is the upright side when the ring comes to rest.

It may be well to point out that either end of shaft 10, as shown in FIGS. 5, 6 or 7, can be used to engage the thrown element, be it the projectile or the ring. Thus, the rules of the game can incorporate a bonus or penalty element, depending upon which end is used by a player during each throw.

While the principls of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. In a game apparatus for directing a projectile toward a goal by manual manipulation of a shaft to engage and sling said projectile, said game apparatus being useable upon an unprepared playing field located on terrain of any configuration and consistency, the improvement comprising:

a. a plurality of non-aligned planar surfaces disposed upon said projectile for insuring that at least one of said planar surfaces is accessible to one end of said shaft while said projectile is at rest upon the playing field;

b. a cavity disposed within each of at least two of said planar surfaces for slidably receiving said one end of said shaft;

c. a laterally extending spur for engaging said shaft with one of said cavities; and d. said goal being non-penetratingly positionable upon the playing field for rendering said goal useable upon any type of playing field terrain; whereby, said game apparatus is playable upon both natural and man made terrain without initial demarcation of a playing field.

2. The improvement as set forth in claim 1 wherein said goal is a ring for circumscribingly receiving said projectile.

3. The improvement as set forth in claim 1 including a collar disposed upon said one end of said shaft for supporting said spur.

4. The improvement as set forth in claim 3 wherein another end of said shaft is dimensioned for insertingly engaging one of said cavities; whereby, either end of said shaft is useable to engage and sling said projectile toward said goal.

5. The improvement as set forth in claim 3 wherein said projectile is a cube and one of said cavities is disposed within each face of said cube.

* * * * *

UNITED STATES PATENT OFFICE

CERTIFICATE OF CORRECTION

Patent No. 3,970,307 Dated July 20, 1976

Inventor(s) John E. Breglia

It is certified that error appears in the above-identified patent and that said Letters Patent are hereby corrected as shown below:

On the cover sheet item [76] 818 E. Copper St., should read --- 812 E. Copper St. ---.

Signed and Sealed this

Twelfth Day of October 1976

[SEAL]

*Attest:*

RUTH C. MASON
*Attesting Officer*

C. MARSHALL DANN
*Commissioner of Patents and Trademarks*